United States Patent [19]

Mattis et al.

[11] Patent Number: 4,648,684

[45] Date of Patent: Mar. 10, 1987

[54] SECURE CONNECTOR FOR COAXIAL CABLE

[75] Inventors: John S. Mattis, Sunnyvale; Jorgen Berth, Los Altos; Gilbert E. Locke, San Mateo, all of Calif.

[73] Assignee: Raychem Corporation, Menlo Park, Calif.

[21] Appl. No.: 753,353

[22] Filed: Jul. 9, 1985

Related U.S. Application Data

[63] Continuation of Ser. No. 560,081, Dec. 9, 1983, abandoned.

[51] Int. Cl.[4] ..... H01R 17/18

[52] U.S. Cl. ..... 339/177 R; 339/113 R

[58] Field of Search ..... 339/177, DIG. 1, 113

[56] References Cited

U.S. PATENT DOCUMENTS

| | | | |
|---|---|---|---|
| 2,671,889 | 3/1954 | Vickery | 339/DIG. 1 |
| 2,869,099 | 1/1959 | Robinson | 339/136 R |
| 3,336,563 | 8/1967 | Hyslop | 339/DIG. 1 |
| 3,437,960 | 4/1969 | Ziegler | 339/177 R |
| 3,453,376 | 7/1969 | Ziegler, Jr. | 339/177 R |
| 3,533,051 | 10/1970 | Ziegler | 339/177 R |
| 3,801,954 | 4/1974 | Dorrell | 339/113 R |
| 4,173,386 | 11/1979 | Kauffman et al. | 339/177 R |
| 4,290,662 | 9/1981 | Storcel | 339/113 R |

FOREIGN PATENT DOCUMENTS

| | | | |
|---|---|---|---|
| 1270367 | 4/1972 | United Kingdom | 339/DIG. 1 |

*Primary Examiner*—Gil Weidenfeld
*Assistant Examiner*—David L. Pirlot
*Attorney, Agent, or Firm*—Dennis E. Kovach; Herbert G. Burkard

[57] ABSTRACT

A connector assembly for a coaxial cable having a substantially rigid electrically conductive jacket, a center conductor and electrical insulation between the jacket and center conductor, which connector includes a body, a mandrel (which may be part of the body) and a clamp nut. The body is adapted for connection to a junction box or other device to which the coaxial cable is connected and contains insulating means for holding the center conductor of the coaxial cable or a pin which is connected to the center conductor. The clamp nut is adapted to be attached to the body and holds the mandrel for maintaining electrical contact with the jacket of the coaxial cable in electrical contact with the body. This invention provides means for securing the clamp nut to the body to prevent the loosening of the clamp nut from the body and to provide a visual indication that the clamp nut has been loosened from the body or that the connector has been reentered. This security feature and visual reentry indication is particularly desired in the CATV industry.

4 Claims, 3 Drawing Figures

SECURE CONNECTOR FOR COAXIAL CABLE

This application is a continuation of application Ser. No. 560,081, filed Dec. 9, 1983, now abandoned.

FIELD OF THE INVENTION

This invention relates to connectors for coaxial cable which has a relatively rigid electrically-conductive jacket, a center conductor and electrical insulation means between the jacket and center conductor.

BACKGROUND OF THE INVENTION

Various types of connectors for coaxial cables of the type referred to above are in wide use, particularly in the CATV industry. These connectors are used to connect coaxial cables with each other, with signal splitters, with amplifiers, with junction boxes and with other equipment. The connectors are of various types such as the feedthrough connector, where the center conductor of the coaxial cable passes through the connector to make electrical contact with another device and the connector makes the electrical contact between the coaxial cable jacket and the other device. In the pin connector, the center conductor of the coaxial cable is connected to a pin which extends from the connector and the jacket of the cable is connected to the body of the connector whereby the pin extending from the connector and the body of the connector form the electrical connection with the other device. Splice connectors, 90° connectors and other configurations are also used.

Heat-recoverable connectors of the type disclosed in copending, commonly assigned application U.S. Ser. No. 531,961 filed Sept. 14, 1983, provide heat-recoverable plastic members which grip the jacket of the cable and/or the center conductor of the cable. Mechanical connectors of the type disclosed in co-pending, commonly assigned application U.S. Ser. No. 480,052 filed Mar. 29, 1983, and those disclosed in U.S. Pat. No. 4,346,958 provide mechanical means for gripping the jacket and center conductor of coaxial cables. The disclosures of the above applications and patent are incorporated by reference herein in their entirety. The various types of coaxial cable connectors typically have the common elements of a connector body, which is adapted for being connected to another device, and a clamp nut, which generally functions to hold the parts of the connector together or hold the jacket of the coaxial cable in the connector. The body of the connector and the clamp nut of the connector may be known by other names, but their general respective functions are basically as described herein. In field installations of these connectors the body and the clamp nut may become loosened from each other due to environmental stresses whereupon the conductor loses its environmental seal and allows moisture to penetrate the interior of the connector causing corrosion and/or loss of electrical efficiency. In addition, unauthorized entry of the connector may occur by separation of the clamp nut from the body of the connector, and if the connector is re-assembled, the unauthorized entry of the connector may not be detected.

SUMMARY OF THE INVENTION

This invention provides a coaxial cable connector having means for securing the body of the connector and the clamp nut together to prevent undesired loosening of one from the other. The means provided in this invention also gives a visual indication of whether or not the clamp nut and the connector body have been loosened from each other. In general, this invention provides a connector for coaxial cable, the cable having substantially rigid electrically-conductive jacket, a center conductor and electrical insulation means therebetween, said connector comprising:

a body containing electrically-insulating means for holding and insulating from electrical contact with the body the center conductor or a pin attached to the center conductor;

a mandrel adapted for maintaining electrical contact with the jacket and the body while allowing the center conductor to pass through without electrical contact with the mandrel or body;

means for gripping the jacket to maintain electrical contact between the jacket and the mandrel;

a clamp nut adapted for holding the mandrel in electrical contact with the body or for holding the means for gripping the jacket in electrical contact with the mandrel; and means for securing the clamp nut in the body together to prevent rotation of the clamp nut relative to the body, said means being adapted to deform upon rotation of the clamp nut relative to the body and provide a visual indication that such rotation has occurred.

In some connectors the clamp nut holds the separate mandrel in electrical connection with the body. In other connectors the mandrel is an integral part of the body and the clamp nut holds the jacket gripping means in place.

It will be apparent to one skilled in the art that this invention is applicable to the various types of coaxial cable connectors discussed above, whether they are heat-recoverable type or mechanical type. It will also be apparent to one skilled in the art that various means for securing the clamp nut to the body may be used following the teachings of this invention. The securing means is to prevent undesired loosening, which may be caused by environmental or use stresses. The securing means is to also provide visual indication of whether or not such loosening, separation or rotation has in fact occurred. For example, such securing means may be mechanical means, adhesive or similar material or heat-recoverable material applied around the body and clamp nut.

BRIEF DESCRIPTION OF THE DRAWINGS

The drawings used to illustrate the preferred embodiment of this invention are the following.

DESCRIPTION OF THE PREFERRED EMBODIMENT

Figure 1:
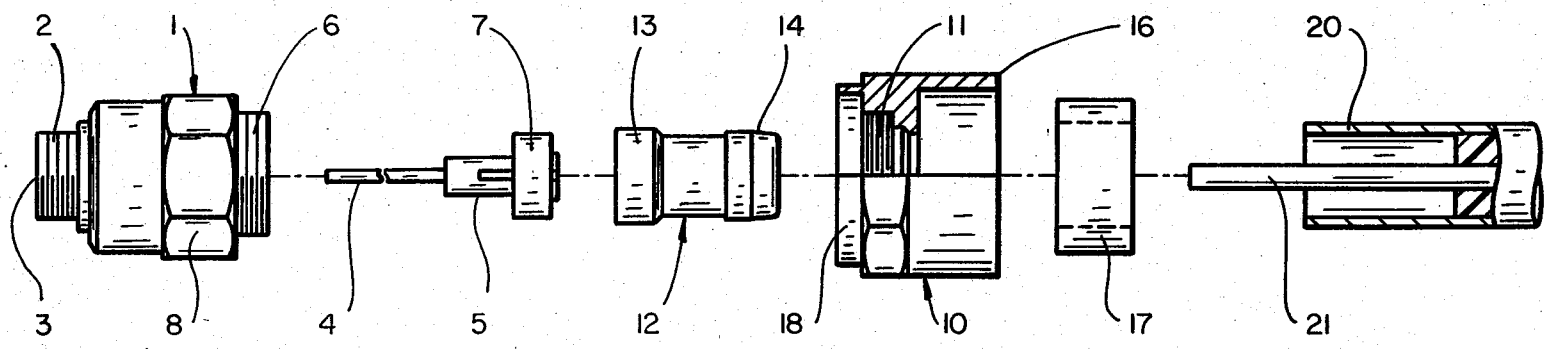
FIG. 1 is an expanded view of a pin-type connector of the heat-recoverable configuration.

FIG. 1 is an exploded view illustration of one of the preferred embodiments of the present invention. Body 1 has threads in area 2 adapted for connecting with a junction box or other connector and an insulating member 3 in the end of body 1 which receives and holds pin 4 which is connected to center conductor gripper 5. Clamp nut 10 has threads at area 11 adapted for mating with threads on body 1 at area 6. Mandrel 12 is adapted to maintain electrical contact with body 1 at area 13 of mandrel 12 and is adapted to maintain electrical contact with the jacket 20 of the coaxial cable at area 14 of mandrel 12. Mandrel 12 is clamped between body 1 and clamp nut 10 when in the assembled position and in turn holds the pin/center conductor gripper assembly 85 in position. In the assembled position, center conductor 21 of the coaxial cable is inserted into center conductor gripper 5, and heat-recoverable ring 7 is recovered to apply the necessary force to maintain the contact between the center conductor gripper 5 and the center gripper conductor 21. Similarly, in the assembled position jacket 20 of the coaxial cable is held in contact with area 14 of mandrel 12 by heat-recoverable ring 17. The securing means in this embodiment is skirt area 18 on clamp nut 10 which extends over a portion of flattened areas 8 of body 1 and is crimped against the flattened surfaces 8. In the crimped condition, skirt 18 prevents rotation of clamp nut 10 with respect to body 1, however, if such rotation occurs, skirt 18 will be forced away from flattened surfaces 8 thus providing a visual indication that such rotation has occurred.

Figure 2:
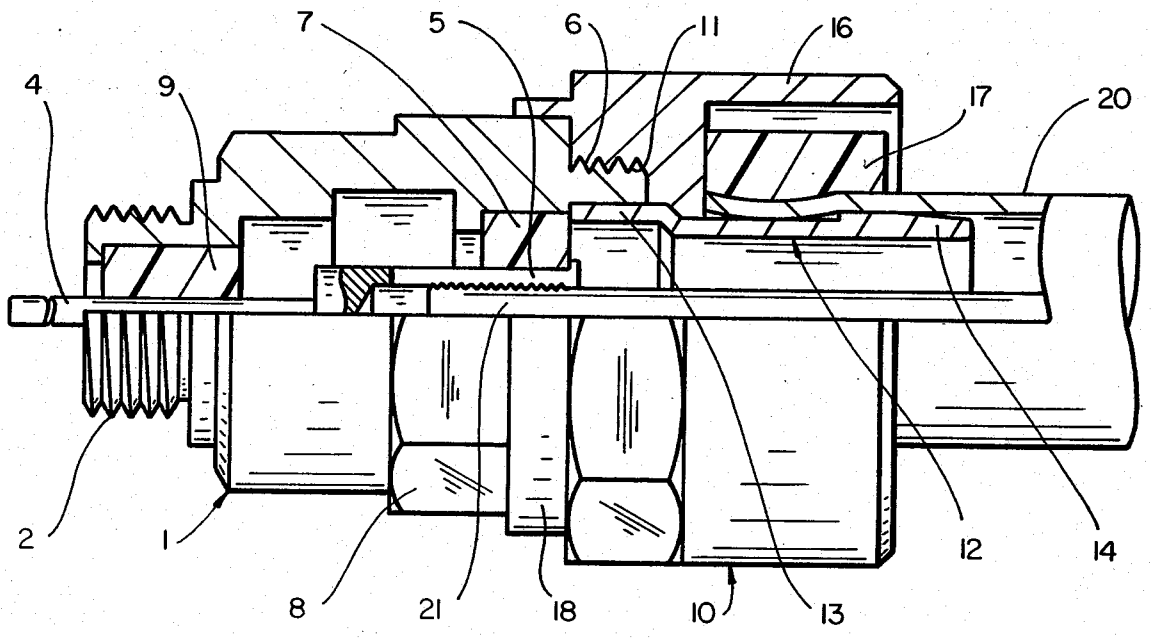
FIG. 2 is an illustration of the assembled connector of FIG. 1.

FIG. 2 shows the connector of FIG. 1 in the assembled condition and in this partial cut-away view the only additional element which is illustrated is the insulating means 9 for insulating the pin 4 from body 1. FIGS. 1 and 2 also show shield portion 16 of the clamp nut which extends over and protects the heat-recoverable ring 17 from direct flames when a torch is used to accomplish the heat-recovery of ring 17 and ring 7. FIG. 2 shows in the assembled condition skirt 18 which is crimped against flat surfaces 8 to provide the securing means for the connector and the visual indication in the event clamp nut 10 is rotated with respect to body 1.

Figure 3:
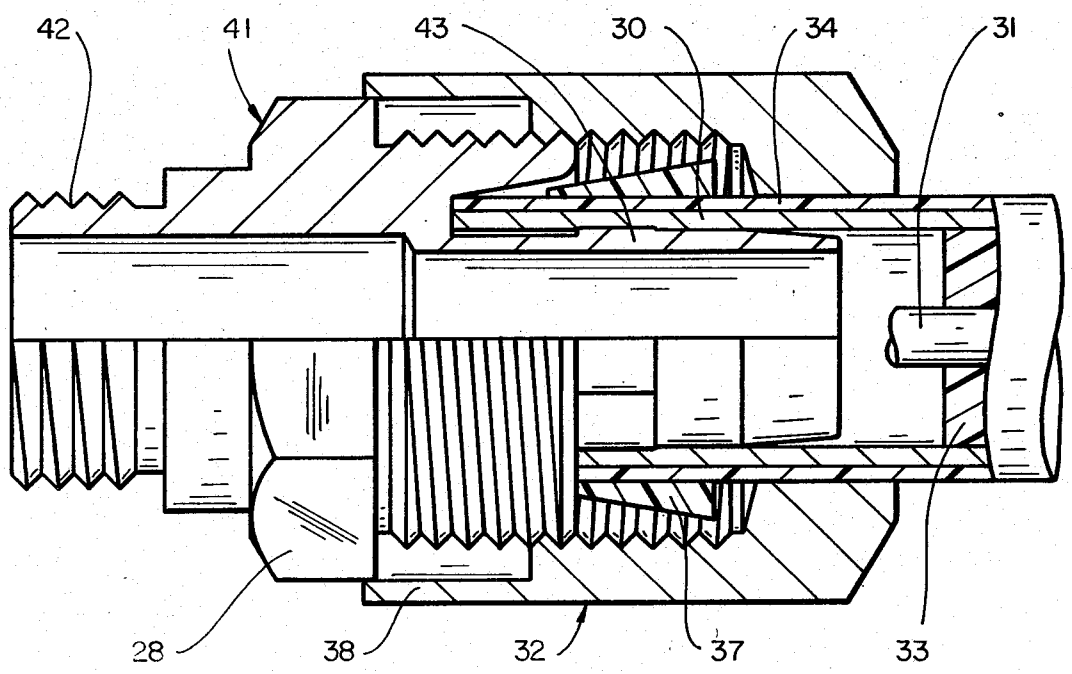
FIG. 3 is an illustration of a feedthrough-type connector of the mechanical configuration.

FIG. 3 shows a mechanical compression-type feed-through connector in the assembled position which shows body 41 with threads 42 for connecting with another device. Body 41 has mandrel 43 formed as an integral part of body 41 which receives cable jacket 30 which has a protective plastic covering thereon 34, which is held in position on the mandrel and clamped against the mandrel by compression means 37. Clamp nut 32, when screwed in position on body 41, provides the necessary force to compression means 37. Skirt 38 on clamp nut 32 extends over flat portions 28 or body 41 for crimping against flat surfaces 28 to provide the securing means to prevent rotation of clamp nut 32 with respect to body 41 and to provide the visual indication if such rotation does occur. Center conductor 31 of the coaxial cable extends from the insulation 33 through clamp nut 32 and body 41.

We claim:

1. A connector for a coaxial cable, the cable having a substantially rigid electrically conductive jacket, a center conductor and electrical insulation means therebetween, said connector comprising:

a body containing electrically-insulating means for holding and insulating from electrical contact with the body the center conductor or a pin attached to the center conductor;

a mandrel adapted for maintaining electrical contact with the jacket and the body while allowing the center conductor to pass through without electrical contact with the mandrel or body;

means for gripping the jacket to maintain electrical contact between the jacket and the mandrel;

a clamp nut adapted for holding the mandrel in electrical contact with the body or for holding the means for gripping the jacket in electrical contact with the mandrel;

means for securing the clamp nut and the body together to prevent rotation of the clamp nut relative to the body, said securing means being adapted to deform upon rotation of the clamp nut relative to the body and provide a visual indication that such rotation has occurred;

the body having a flattened surface area on the exterior thereof and the means for securing the clamp nut and the body together is a skirt on the clamp nut extending over the flattened surface area of the body and a portion thereof being adapted for crimping against said flattened surface, the skirt portions being crimped against the flattened surface area.

2. A connector of claim 1 wherein the means for gripping the jacket is a mechanical compression means.

3. A connector of claim 1 wherein the means for gripping the jacket is a heat-recoverable ring positioned around the jacket.

4. A connector of claim 3 wherein the clamp nut has a shield portion extending over the heat-recoverable ring.

* * * * *